US009657944B2

(12) United States Patent
Debashis et al.

(10) Patent No.: US 9,657,944 B2
(45) Date of Patent: May 23, 2017

(54) ASSEMBLY FOR FOSSIL FUEL DISTRIBUTION

(75) Inventors: Dey Debashis, West Bengal (IN); Sauren Banerjee, Kolkata (IN); Aditya Krishnendu, Kolkata (IN)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 637 days.

(21) Appl. No.: 13/821,974

(22) PCT Filed: Aug. 29, 2011

(86) PCT No.: PCT/IB2011/001982
§ 371 (c)(1),
(2), (4) Date: May 23, 2013

(87) PCT Pub. No.: WO2012/032382
PCT Pub. Date: Mar. 15, 2012

(65) Prior Publication Data

US 2013/0291769 A1 Nov. 7, 2013

(30) Foreign Application Priority Data

Sep. 9, 2010 (IN) ..... 2142/DELNP/2010

(51) Int. Cl.
*F23K 1/00* (2006.01)
*F23K 3/02* (2006.01)

(52) U.S. Cl.
CPC ..... *F23K 3/02* (2013.01); *F23K 1/00* (2013.01); *F23K 2201/101* (2013.01); *F23K 2203/105* (2013.01); *F23K 2203/201* (2013.01)

(58) Field of Classification Search
CPC ..... F23K 2203/105
USPC ..... 406/181
See application file for complete search history.

(56) References Cited

U.S. PATENT DOCUMENTS 53,208 A * 3/1866 Weelpley ..... F23C 10/002 110/101 R
64,090 A * 4/1867 Fletcher ..... F23L 9/00 110/302
405,966 A * 6/1889 Mason ..... F23C 10/002 110/347

(Continued)

FOREIGN PATENT DOCUMENTS

CA 2388666 A1 11/2003
CN 1243567 A 2/2000

(Continued)

OTHER PUBLICATIONS

Japanese Notification of Reasons for Refusal corresponding to JP Appln. No. 2013-527692, dated Jan. 27, 2014.

(Continued)

*Primary Examiner* — Kenneth Rinehart
*Assistant Examiner* — Logan Jones
(74) *Attorney, Agent, or Firm* — GE Global Patent Operation; Stephen G. Midgley

(57) ABSTRACT

The present invention relates to the field of fossil fuel combustion arrangement. It relates in particular to a fuel distribution assembly for equal and homogenous pulverized fuel distribution in pulverized fuel conduits throughout. It also relates to a system for providing an equal and homogenous pulverized fuel distribution.

14 Claims, 5 Drawing Sheets

(56) References Cited

U.S. PATENT DOCUMENTS 1,421,386 A * 7/1922 Bell ..... F23C 1/00 110/344
1,707,335 A * 4/1929 Van Brunt ..... B65G 53/521 122/44.2
1,754,124 A * 4/1930 Skentelbery ..... B65G 53/528 406/155
1,805,940 A * 5/1931 Dolan ..... B65G 53/521 406/181
1,825,668 A 10/1931 Kennedy
1,825,688 A 10/1931 Kennedy
1,913,675 A * 6/1933 Kerr ..... F23K 3/00 406/155
2,364,633 A * 12/1944 Hardgrove ..... F23K 3/00 285/125.1
4,027,920 A 6/1977 Wennerstrom
4,155,511 A 5/1979 Kartman et al.
4,392,438 A 7/1983 Dooley
4,630,554 A * 12/1986 Sayler ..... B02C 13/18 110/104 B
4,979,429 A * 12/1990 Soethout ..... B60H 1/3442 454/162
5,241,915 A * 9/1993 Breen ..... F23K 1/04 110/232
6,055,914 A * 5/2000 Wark ..... F23K 3/02 110/101 R
6,186,079 B1 * 2/2001 Wark ..... F23K 3/02 110/101 R
6,234,090 B1 * 5/2001 Wark ..... F23K 3/02 110/104 A
6,257,415 B1 * 7/2001 Wark ..... B02C 23/16 209/143
6,290,266 B1 9/2001 Kawano
6,988,452 B2 1/2006 Vatsky
7,102,574 B2 9/2006 Otaka et al.
7,341,007 B2 3/2008 Vatsky
8,590,464 B2 11/2013 Matsumoto et al.
2001/0037962 A1 * 11/2001 Wark ..... B02C 23/16 209/722
2003/0209470 A1 * 11/2003 Wark ..... B02C 23/16 209/143
2004/0206279 A1 * 10/2004 Wark ..... F23K 3/02 110/104 R
2005/0042043 A1 * 2/2005 Levy ..... F23K 3/02 406/181
2005/0160953 A1 * 7/2005 Mann ..... F23K 3/02 110/106
2010/0006012 A1 * 1/2010 Matsumoto ..... F23C 7/008 110/218
2011/0210196 A1 9/2011 Hoffmann et al.

FOREIGN PATENT DOCUMENTS

CN 2583521 Y 10/2003
EP 2359935 A1 8/2011
JP S61-192966 U 12/1986
JP S63-104831 U 7/1988
JP S63-271019 A 11/1988
JP 2000-046315 2/2000

OTHER PUBLICATIONS

Notice of Allowance for JP Appln. No. 2013-527692 dated Jul. 21, 2015.
Unofficial English Translation of Taiwan Office Action and Search Report issued in connection with corresponding TW Application No. 100132477 on Feb. 7, 2014.

* cited by examiner

ASSEMBLY FOR FOSSIL FUEL DISTRIBUTION

This is a U.S. National Phase application of International Application Number PCT/IB2011/001982, filed Aug. 29, 2011, which is incorporated herein by reference in its entirety. International Application Number PCT/IB2011/001982 cites for priority India Application No. 2142/DELNP/2010 having a Filing Date of Sep. 9, 2010, incorporated herein in its entirety by reference.

FIELD OF INVENTION

The present invention relates to the field of fossil fuel combustion arrangement. It relates in particular to a fuel distribution assembly for equal and homogenous pulverized fuel distribution in pulverized fuel conduits throughout. It also relates to a system for providing an equal and homogenous pulverized fuel distribution.

BACKGROUND OF THE INVENTION

Coal coming out of mines is required to be crushed first in a crushing device at power plant yards. The Crushing device crushes coal with around 2-centimeter diameter. This crushed coal is then pulverized to powder in coal mills. This pulverization is required for better burning in a boiler. Burning of coal releases heat to produce steam at the boiler. This steam rotates a turbine and alternator to produce electricity.

Pulverized coal coming out from coal mill is required to be evenly distributed in all individual burners for better burning and desired boiler efficiency. Otherwise it results in unburnt coal and unequal temperature at different zones of the boiler. In a typical boiler, coal particle and a primary airflow are fed from a pulverizer to the burners through a network of fuel lines. A single large diameter main conduit along with further branching of numerous small diameter conduits form a fuel line. Primary air helps the pulverized fuel to move towards the boiler. A single conduit is used in carrying pulverized fuel from the coal mill and further branches into smaller conduits to feed burners of the boiler. At branching of single conduit into numerous smaller conduits a flow imbalance takes place. Many users complain about the phenomenon of unequal temperatures in-side the boiler. Investigations revealed that unequal flow after the coal mill is a major cause of such imbalance.

Coal has to travel a long path sometimes about 30 to 50 meters after outlet at coal mill. Because of differences in conduits lengths and numbers and types of elbows in each fuel line, the different conduits from a pulverize mill usually have different flow resistances.

Sometimes an orifice is fitted in each fuel line coming out of the mill. Orifices help to reduce flow imbalance only. But these orifices or flow restrictors are not sufficient. The long travel increases possibility of unequal flow through conduits.

Another phenomenon takes place with high velocity air (around 30 meter per second) is the formation of concentrated flow in one side of large diameter conduit, which is called "rope formation".

Imbalances in pulverized fuel flow through conduits also lead to maintenance problems associated with conduits erosion and/or clogging for example excessive localized coal accumulation, damage to burners and wind boxes, and accelerated water wall wastage. Problems such as these reduce the operating flexibility of the boiler.

Effort of equal flow to each burner thus gets impaired due to complexity of the situation. A burner imbalance leads to higher carbon monoxide emissions and high levels of unburned carbons. Large and old boilers thus suffer from lesser effectiveness of burners. Most of the boilers have numerous burners that are to be fed by a single coal mill.

Also lesser space to accommodate new device is a typical problem in existing boilers. Currently there is a need for a solution in industry for removal of imbalance in coal flow to burners. At the same time the boilers require homogeneous flow of pulverized fuel (crushed coal). The solution needs to be used in space constraints and it should be cost effective.

The problem arises when coal mill outlet branches out in several numbers of smaller diameter conduits or ducts to reach individual burner of a boiler. The resistance of each branches being unequal due to different lengths and varieties of configuration causes unequal output of pulverized fuel. Concentrated flow of pulverized fuel (coal rope) inside the conduit is another problem that causes erosion and unequal flow. Although here we described the problems due to coal, similar problems are also there when any other fuel is used.

Object of the Invention

It is an object of the present invention to provide an assembly that provides equal pulverized fuel to the pulverized fuel conduits and homogenous flow of pulverized fuel through-out the pulverized fuel conduits.

In another object of the present invention is to provide an assembly that withstands the erosion effects of coal and increases the life of pulverized fuel conduits supplying pulverized fuel.

It is another object of the present invention is to provide an assembly which maintains sufficient pressure drop across the pulverized fuel conduits which is necessary for the supply of pulverized fuel.

SUMMARY

The present invention provides an assembly for pulverized fuel distribution from a mill to a boiler comprising a support unit and a resistance unit. The support unit comprises at least one tube. The resistance unit is disposed inside the at least one tube providing resistance and orientating the pulverized fuel flow.

The support unit comprises an inner tube and an outer tube having same central axis. The support unit holds the whole assembly. The resistance unit comprises at least one partition plate and at least one deflector.

The deflector comprises a first and a second tapered side walls attached to a base structure, the deflector is positioned such that the base structure forms a passage for a zig zag movement of the pulverized fuel.

The partition plate is embedded inside the inner tube and the deflector is circumferentially distributed between the inner tube and the outer tube. The partition plate provides partial resistance to the flow of pulverized fuel.

The base structures are alternatively attached to an inner surface of the outer tube and to an outer surface of the inner tube. The base structure is angled with respect to the central axis of the at least one tube. The first and the second tapered side walls are angled alternatively towards and away respectively with respect to the central axis of the tube.

The partition plate is extending in a radial direction from the central axis of the tube.

The present invention provides a system for pulverized fuel distribution from a mill to a boiler comprising a heater that generates a primary air, a mill that pulverized the coal into pulverized fuel, the pulverized fuel being supplied with the help of primary air through a main pulverized fuel conduit, an assembly that provides pulverized fuel equally and homogenously into the main pulverized fuel conduit, a distributor that furcates the main pulverized fuel conduit into smaller pulverized fuel duct, the smaller pulverized fuel ducts feeding equal and homogenous pulverized fuel to the burners of a boiler.

The assembly is embedded inside the main pulverized fuel conduit.

In another embodiment the assembly is installed between the main conduit and the distributor.

BRIEF DESCRIPTION OF THE DRAWINGS

The invention, its further features, nature as well as its advantages, shall be described in more details with the aid of accompanying drawings. Referring to the drawings FIG. 1 schematically shows an embodiment of an assembly installed in a power plant, FIG. 2 schematically shows a front exploded perspective view of an assembly, FIGS. 2*a* and 2*b* schematically shows perspective view of two embodiments of the deflectors for the assembly, FIG. 2*c* schematically shows a perspective view of partition plate of the assembly, FIG. 3 schematically shows a partial transverse view of an assembly, FIG. 4 schematically shows a plan view of an assembly, FIG. 5 schematically shows a bottom perspective view of an assembly.

DETAIL DESCRIPTION OF THE DRAWINGS AND THE INVENTION

Figure 1:
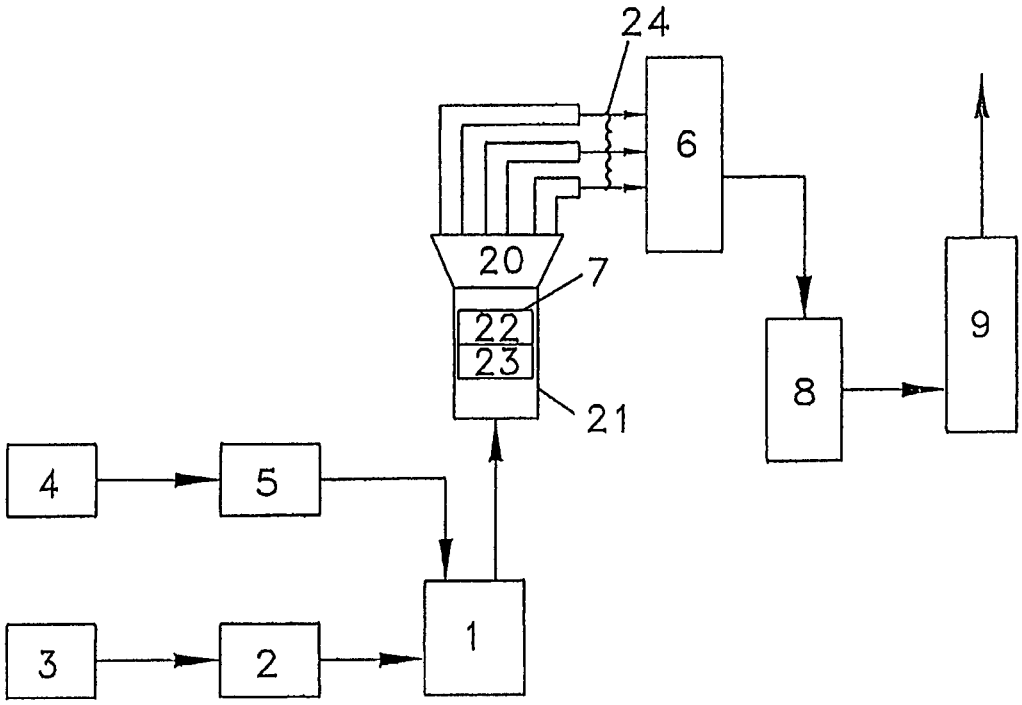

In FIG. 1, reference numeral 1 denotes a coal mill that receives primary air 2 from air heater 3 and crushed coal from a crusher device 4 through a coal feeder 5. The coal mill 1 further pulverizes the coal to powder size. Pulverized fuel is moved with the help of primary air 2 towards a boiler 6 through a main pulverized fuel conduit 21. The main pulverized fuel conduit 21 is connected with the coal mill 1.

A distributor 20 is provided for furcating the main pulverized fuel conduit 21 into a branching of smaller pulverized fuel ducts 24. The distributor 20 is attached for example through flange or nut bolts with the main pulverized fuel conduit 21 from one side and to the branching of smaller pulverized fuel ducts 24 from other side towards the burners of the boiler 6.

An assembly 7 is embedded inside the main pulverized fuel conduit 21 in a non-moveable way for example through welding. The assembly 7 provides equal and homogenous fuel to the distributor 20 for distributing it into branching of at least one smaller pulverized fuel duct 24. Alternatively the assembly 7 is installed between the main pulverized fuel conduit 21 and distributor 20.

The branching of smaller pulverized fuel ducts 24 feeds equal and homogenous pulverized fuel to the burners of the boiler 6. The emissions from boiler 6 after passing through an electrostatic precipitator 8 are discharged through a chimney 9.

The assembly 7 comprises a support unit 22 and a resistance unit 23. The support unit 22 is configured to hold the resistance unit 23 and provides strength and support to the fuel distribution assembly 7. The support unit 22 is attached to the main pulverized fuel conduit 21 for example through welding and flanges.

The resistance unit 23 is configured to provide resistance to the pulverized fuel flow so that equal pulverized fuel is supplied to the branching of smaller pulverized fuel ducts 24 and also orients the pulverized fuel flow into homogenous pulverized fuel flow through out the smaller pulverized fuel ducts 24. The resistance unit 23 is embedded inside and attached to the support unit 22 for example through welding and flanges.

Figure 2:
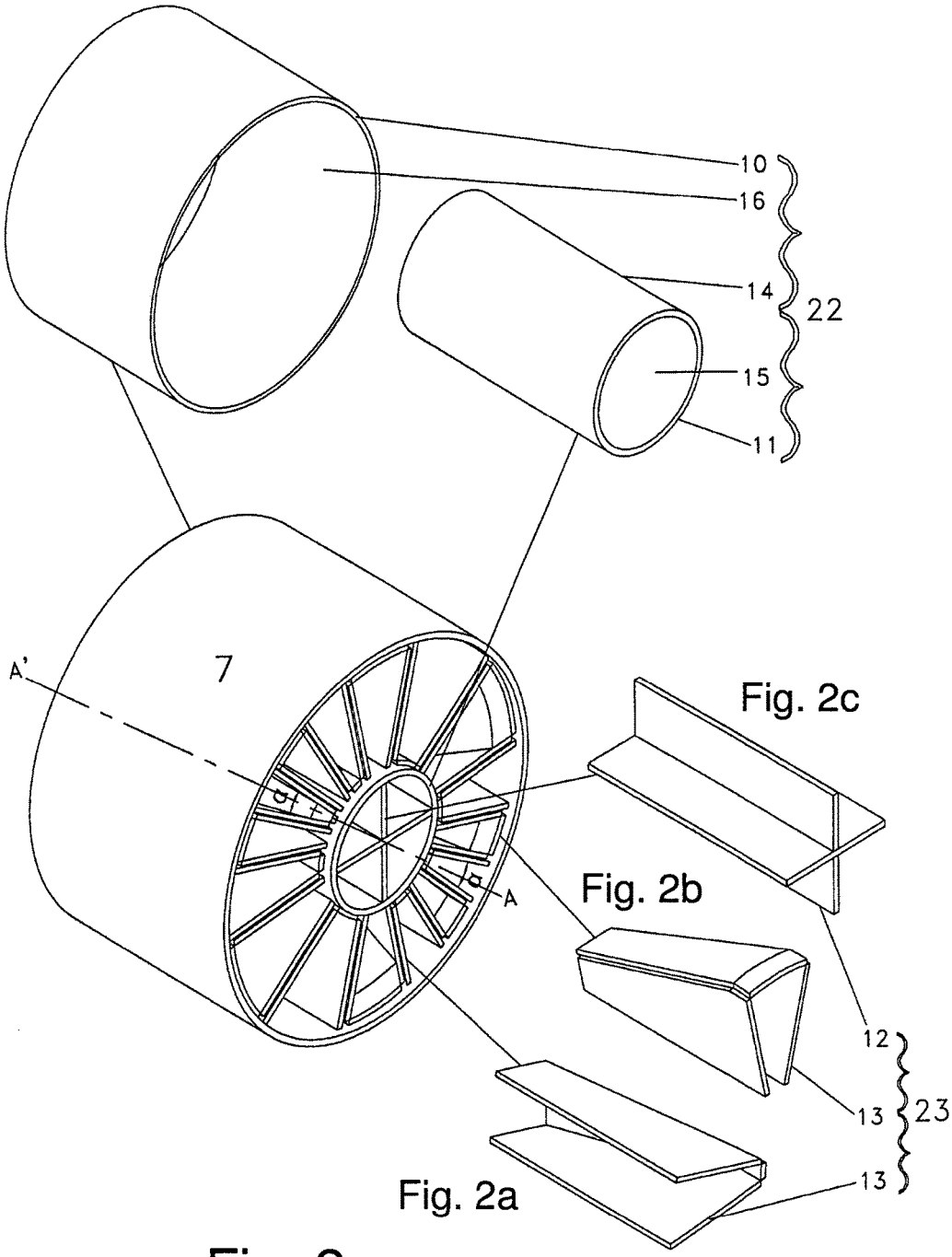

The support unit 22 comprises at least one tube. In one embodiment as represented in FIG. 2, the support unit comprises for example two concentric tubes: an outer tube 10 and an inner tube 11. The inner tube 11 provides support, rigidity and toughness to whole assembly 7 during the online condition when boiler 6 is fully operational. The outer tube 10 protects the whole assembly 7 from the corrosion effects, which occurs due to movement of pulverized fuel through it and holds the whole assembly 7. The length of outer tube 10 and the inner tube 11 corresponds to the length of the assembly 7.

Means for attachment are provided in form of welding, flanges, zigs, fixtures nut bolts, rivets and any other type for attaching the assembly 7 to the main conduit 21. The outer tube 10 is attached to the main pulverized fuel conduit 21 for example through welding or joined by a flange.

The resistance unit 23 comprises at least one partition plate 12 attached for example through welding or flange inside the inner tube 11 and at least one deflector 13 equally circumferentially distributed between the inner tube 11 and the outer tube 10. The assembly for example can have only one tube 10,11 to which for example at least one partition plate 12 or at least one deflector 13 attached through welding or flange. The partition plate 12 provides partial resistance to the flow of pulverized fuel. The deflectors 13 provide optimum resistance to the movement of pulverized fuel flow leading to accumulation of pulverized fuel downstream at the entry point of the assembly 7.

Each of the deflectors 13 is attached for example through welding or flange to an outer surface 14 of the inner tube 11 and to an inner surface 16 of the outer tube 10. The deflectors 13 and partition plates 12 may be attached directly for example through welding or through flanges with main pulverized fuel conduit 21. Zigs, fixtures and nut bolts can also be provided with main pulverized fuel conduit 21 for attachment. The resistance unit 23 is disposed inside the at least one tube for example the partition plates 12 inside the inner tube 11 and/or the deflectors inside the outer tube 10.

The central axis of the tubes 10, 11 is denoted by A-A' and is parallel to the central axis of main conduit 21.

The partition plates 12 as shown schematically in FIG. 2*c* are flat surfaced and rectangular in shape. The partition plates 12 are attached for example by welding along the circumference to an inner surface 15 of the inner tube 11 and orthogonally placed from each other. The partition plates 12 can have a curved surface and any shape including square.

The partition plates 12 are extending in a radial direction from the central axis A-A'.

The main conduit 21, tubes 10, 11 and further smaller pulverized fuel ducts 24 can be of any shape including circular.

FIG. 2*a*, 2*b* shows perspective view of two embodiments of the deflectors 13. The two embodiments of the deflectors 13 are symmetrical. The deflectors 13 comprise a first tapered side wall 17 and a second tapered side wall 18 attached along at one of their ends to a base structure 19 in between.

The deflectors 13 are positioned such that the base structure 19 attached to the first tapered side wall 17 and the second tapered sidewall 18 forms a passage for the movement of the pulverized fuel. The base structure 19 can have any shape including rectangular, square, parallelogram. The base structure 19 corresponds to the length of the assembly 7, measured along the axis A-A'.

The first 17 and the second 18 tapered sidewalls are angled alternatively towards and away respectively with respect to the central axis A-A'. The tapered sidewalls angle α, shown in FIG. 2 is the angle of the tapered sidewalls with respect to central axis A-A'. The angle α is with in range of 0 degree to 180 degrees with respect to the central axis or more preferably in the range of 10 to 20 degrees. The first 17 and the second 18 tapered side walls are angled to provide optimum resistance in the path of pulverized fuel so that maximum amount of air and pulverized fuel can pass through them. This optimum resistance helps in equal and homogenous distribution of pulverized fuel into the at least one smaller pulverized fuel duct for feeding the burners of the boiler 6 through the deflector 20. The first tapered side wall 17 and the second tapered side wall 18 can have any shape including trapezium, rectangular, square, parallelogram The angling of first 17 and the second 18 tapered side walls also helps in maintaining an optimum velocity and minimum pressure drop which is necessary for the flow of pulverized fuel, so that the assembly 7 does not become a hindrance in flow of pulverized fuel.

Figure 3:
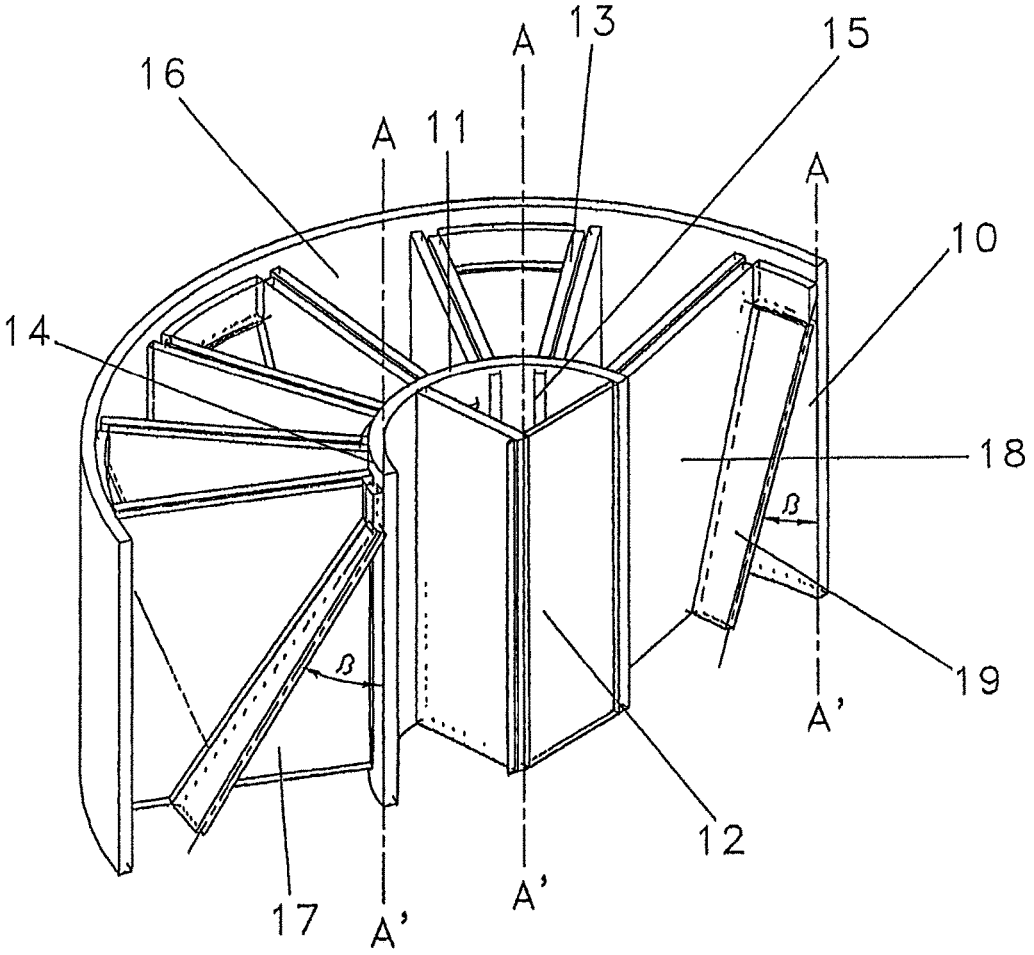
Figure 4:
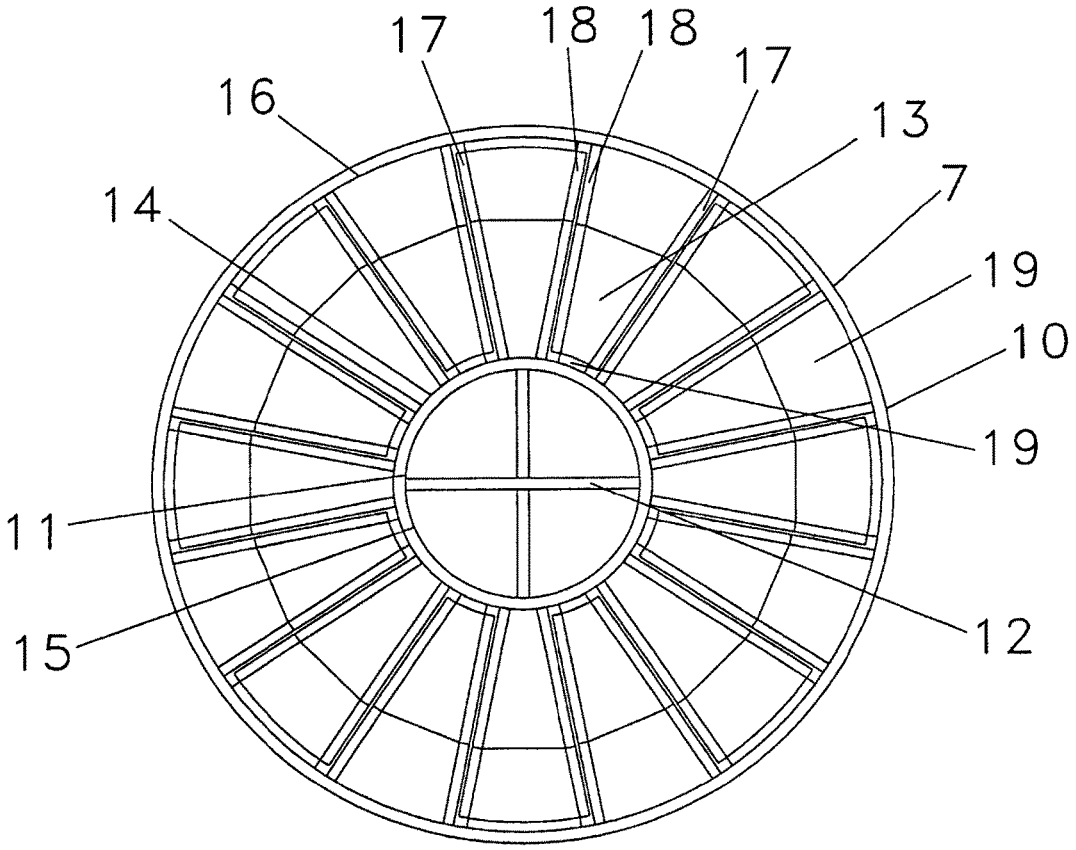
Figure 5:
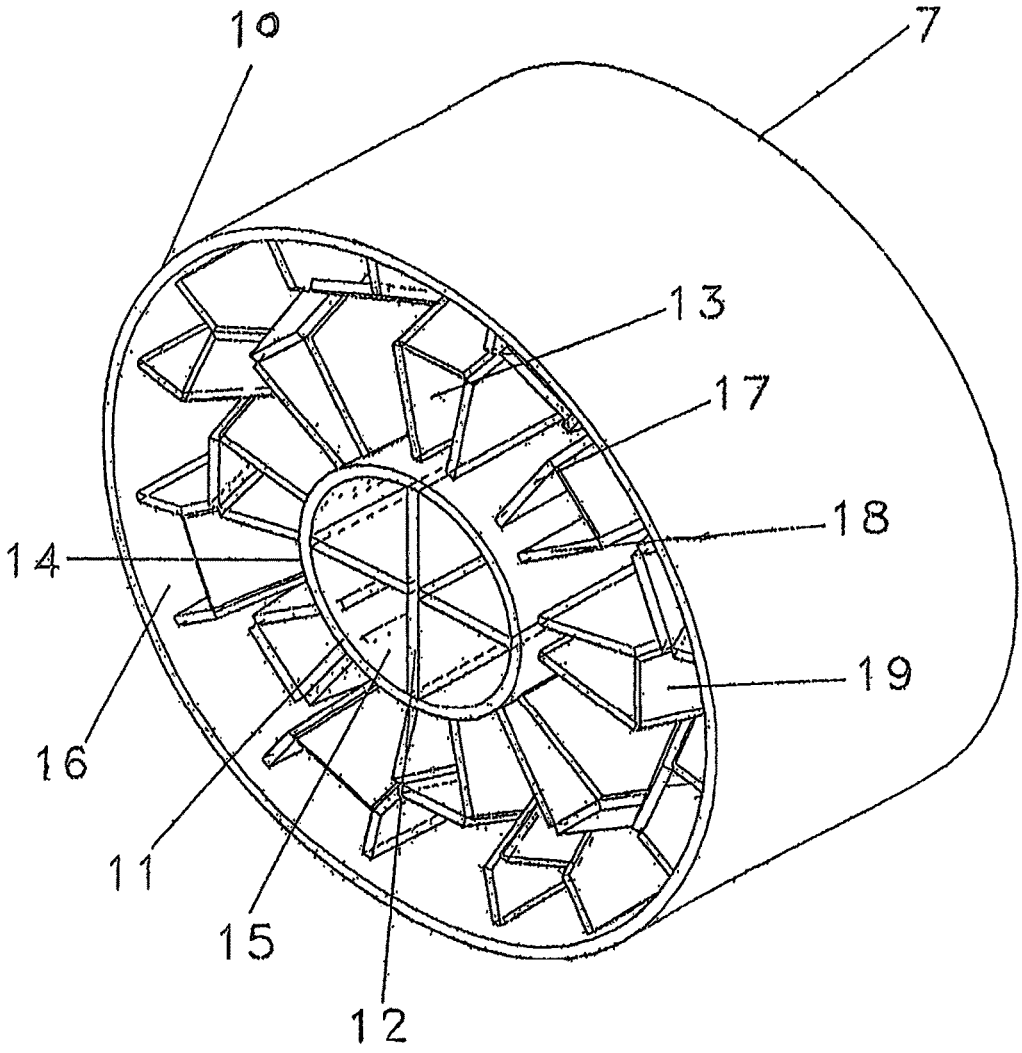

In FIG. 3 angled base structures 19 are shown in a transverse partial view of the assembly 7. The base structures 19 angle β is the angle of the base structure 19 with respect to central axis A-A'. The base structures 19 angle β is with-in range of 0 degree to 90 degrees with respect to the central axis A-A' or more preferably in the range of 10 to 30 degrees. The angling of base structure 19 provides optimum resistance to break the rope formation and equal distraction, which leads to equal and homogenous distribution of pulverized fuel in the branching of the smaller pulverized fuel ducts 24. The equal and homogenous pulverized fuel move upstream homogenously in central portions of the branching of the smaller pulverized fuel ducts 24.

The geometrically symmetrical deflectors 13 are attached for example through welding between the inner tube 11 and the outer tube 10 in such a way that the base structures 19 of the deflectors 13 are alternatively attached to the inner surface 16 of the outer tube 10 and to the outer surface 14 of the inner tube 11. Pulverized fuel moves towards the central axis A-A' along the deflector 13 angled towards the central axis A-A' through base structure 19 attached to the inner surface 16 of the outer tube 10 or alternatively towards periphery of outer tube 10 along the deflector 13 angled away from central axis A-A' through base structure 19 attached to the outer surface 14 of the inner tube 11.

Means for transporting the pulverized fuel through the assembly 7 are provided for example a main pulverized fuel conduit 21, numerous smaller pulverized fuel ducts 24 concentric tubes 10,11 or conveyer belt or any similar type of arrangement.

Means for supporting the assembly 7 are provided through the support unit 22 for example concentric tubes 10,11, and any other similar arrangement.

Means for resistance are provided in form of deflector 13, tapered sidewalls 17,18 and angled base plates 19, structures, of any shape and size and any other type in the assembly 7 to the flow of pulverized fuel.

The assembly 7 is used for a laminar flow, a periphery flow and a turbulent flow. Basically type of flow has no impact on the working of the assembly 7. The assembly 7 ensures an equal distribution of pulverized fuel and breaking of concentrated flow of pulverized fuel to homogeneous one for any kind of flow. The assembly 7 provides low to high resistance through partition plates 12 and deflectors 13 respectively. Most of the pulverized fuel having laminar flow passes through partition plates 12 but in case of peripheral and turbulent flow high resistance is provided through deflectors 13 for equal distribution and breaking of rope formation.

Due to resistance, pulverized fuel coming from coal mill 1 starts accumulating before the assembly 7. The pulverized fuel starts moving towards deflectors 13. The base structure 19 of the deflector 13 pushes the pulverized fuel towards the central axis A-A' and towards a periphery of the outer tube 10. A zigzag movement results in the downstream-pulverized fuel due to this particular arrangement. This zig zag movement leads to equal distribution of the pulverized fuel and breaks the rope formation to a large extent. Rope formation occurs due to high concentration of pulverized fuel in one side or periphery regions of the main pulverized fuel conduit 21 supplying pulverized fuel from coal mill 1 to the assembly 7.

After passing over the assembly 7, the pulverized fuel is converted in to a homogenous equal upstream-pulverized fuel with a desired flow pattern. This homogenous equal upstream-pulverized fuel is supplied through the branching of the smaller pulverized fuel ducts 24 to the burners of the boiler 6.

The pulverized fuel is directed preferentially towards the plurality of partition plates 12 in case of a laminar flow. The pulverized fuel is directed preferentially towards the plurality of deflectors 13 in case of a periphery flow and turbulent flow.

In another embodiment a system for pulverized fuel distribution from a mill to a boiler comprising a heater that generates a primary air, a mill that pulverized the coal into pulverized fuel, the pulverized fuel being supplied with the help of primary air through a main pulverized fuel conduit, an assembly that provides pulverized fuel equally and homogenously into the main pulverized fuel conduit, a distributor that furcates the main pulverized fuel conduit into smaller pulverized fuel duct, the smaller pulverized fuel ducts feeding equal and homogenous pulverized fuel to the burners of a boiler.

The assembly 7 can be applicable to other fossil fuels including gas although the description is here regarding coal.

By using the present assembly 7, imbalances in fuel distribution have been greatly reduced resulting in, for examples, with-in 2% variation from mean flow.

The assembly 7 may be produced in any desired shape or size including circular, elliptical and cylindrical. It may be available singly, in multiples, or in a "set" of varying sizes and shapes to suite existing layouts or the proposed lay outs according to user needs. It may vary in shape and dimensions as determined by its desired locality and can be designed for any length and size of the main conduit 21 as well as further smaller pulverized fuel ducts 24.

The assembly 7 can be placed in a "set" in multiple outlets from multiple coal mills as well as in the further smaller pulverized fuel ducts 24.

The assembly 7 is attachable vertically along the axis of vertically placed conduits, horizontally along the axis of horizontally placed conduits and in inclination along the axis of inclined conduits.

The assembly 7 is made of mild steel with hard faced steel conduit with internal fitments of specific designed numbers of plates. It can also be prepared through any similar material including stainless steel and cast iron.

The assembly 7 is preferably light in weight and may be dismantled and relocated in very short span of time.

The assembly 7 is inexpensive, easily fit in the existing systems with minimum alteration of existing systems and needs very less space.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

We claim:

1. A system for pulverized fuel distribution from a mill to a boiler comprising:

a heater that generates a primary air;

a mill that pulverizes the coal into pulverized fuel, the pulverized fuel being supplied with the help of primary air through a main pulverized fuel conduit;

an assembly that provides pulverized fuel into the main pulverized fuel conduit, the assembly having:

an outer tube;

an inner tube disposed within the outer tube along a common central axis;

a plurality of deflectors disposed circumferentially about the central axis between the inner tube and the outer tube to provide resistance to the pulverized fuel flow in the outer tube; and at least one partition plate disposed within the inner tube to provide resistance to the pulverized fuel flow in the inner tube, the at least one partition plate extending substantially entirely across the inner tube through the common central axis;

a distributor that furcates the main pulverized fuel conduit into smaller pulverized fuel ducts, the smaller pulverized fuel ducts feeding homogenous pulverized fuel to the burners of a boiler.

2. The system for pulverized fuel distribution according to claim 1, wherein the assembly is embedded inside the main pulverized fuel conduit.

3. The system for pulverized fuel distribution according to claim 1, wherein the assembly is installed between the main conduit and the distributor.

4. The system according to claim 1, wherein a portion of the deflectors direct the pulverized fuel towards the central axis and a portion of the deflectors direct the pulverized fuel away from the central axis.

5. The system according to claim 1, wherein the deflectors in alternating manner direct the pulverized fuel towards the central axis and away from the central axis.

6. The system of claim 1, wherein the pulverized fuel flow passing through the outer and the inner tube provides a homogenous pulverized fuel flow to a main pulverized fuel conduit prior to the furcation and distribution of the homogeneous pulverized fuel to the boiler.

7. The system of claim 1, wherein each deflector comprises a first and a second tapered side walls attached to a base structure, the deflector is positioned such that the base structure forms an passage for a zig-zag movement of the pulverized fuel.

8. The system according to claim 1, wherein the at least one partition plate is a pair of partition plates.

9. The system according to claim 1, wherein the pair of partition plates are orthogonal to each other.

10. The system according to claim 8, wherein at least one of the partition plates has a flat surface.

11. The system according to claim 7, wherein the base structures are, in an alternating manner, attached to an inner surface of the outer tube and to an outer surface of the inner tube.

12. The system according to claim 7, wherein the base structure is angled with respect to the central axis of the tube.

13. The system according to claim 7 wherein first and the second tapered sidewalls are angled alternatively towards and away respectively with respect to the central axis of the tube.

14. The system according to claim 1, wherein the at least one partition plate is extending in a radial direction from the central axis of the tube.

* * * * *